US005632338A

United States Patent [19]

Hunter

[11] Patent Number: 5,632,338

[45] Date of Patent: May 27, 1997

[54] LOW PRESSURE, SELF-CONTAINED FIRE SUPPRESSION SYSTEM

[75] Inventor: Wesley Hunter, Eugene, Oreg.

[73] Assignee: The Hunter Group Corporation, Eugene, Oreg.

[21] Appl. No.: 521,620

[22] Filed: Aug. 31, 1995

[51] Int. Cl.[6] ..... A62C 35/02

[52] U.S. Cl. ..... 169/9; 169/15

[58] Field of Search ..... 169/9, 14, 15

[56] References Cited

U.S. PATENT DOCUMENTS

| | | | |
|---|---|---|---|
| 3,337,195 | 8/1967 | Farison | 169/15 |
| 3,750,754 | 8/1973 | Stults | 169/15 |
| 3,822,217 | 7/1974 | Rogers | 252/359 E |
| 3,977,474 | 8/1976 | Goegli | 169/9 |

FOREIGN PATENT DOCUMENTS

| | | | |
|---|---|---|---|
| 523413 | 4/1956 | Canada | 169/15 |
| 652798 | 11/1962 | Canada | 169/15 |
| 2246294 | 1/1992 | United Kingdom | 169/14 |

OTHER PUBLICATIONS

Engineering Analysis of Threshold Compressed Air Foam Systems, U.S. Dept. of Agriculture, Oct. 1987, pp. 2 & 3 especially.

Diaphragm Pressure Tanks, Water Ace Pump Co., Feb. 1993.

Volumetric Metering Pumps, Dosatran International.

*Primary Examiner*—Gary C. Hoge

*Attorney, Agent, or Firm*—Robert E. Howard

[57] ABSTRACT

A low pressure, self-contained fire suppression system comprising a source of pressurized gas, a water reservoir tank containing water, a foam concentrate tank containing foam concentrate, and a water driven volumetric metering pump. The source of gas under pressure communicates with the water reservoir tank to provide a source of water under pressure. A conduit communicates the pressurized water tank with a first inlet port of the metering pump. The foam concentrate tank communicates with the metering pump via a second inlet port. Concentrate is supplied to the metering pump at a predetermined volumetric flow rate in response to water flowing through the metering pump. The source of pressurized gas also communicates via a conduit with the outlet port of said metering pump to thereby introduce gas under pressure to the water/foam concentrate mixture as it exits the metering pump. The water, foam concentrate and gas mixture is passed through a conduit, such as a hose, wherein a foam is generated. The foam passes to a valve and nozzle assembly where the foam can be directed to a fire or structure to be protected from an advancing fire. The source of pressurized gas communicating with the water reservoir and the outlet port of the metering pump is adjusted to maintain the pressure of the water and the gas going to the outlet port of the metering pump at substantially the same pressure of between about 30 and about 70 psig. The system requires no connection to external power or water to generate fire suppression foam.

5 Claims, 3 Drawing Sheets

LOW PRESSURE, SELF-CONTAINED FIRE SUPPRESSION SYSTEM

BACKGROUND OF THE INVENTION

This invention relates to a low pressure, self-contained fire suppression system for Class A or Class B fires and other applications. The fire suppression system of this invention generates a fire suppression foam from foam concentrate, water and a gas such as air or nitrogen. The fire suppression system of this invention is self-contained in that it does not require connection to an external water, pressurized gas or power supply. The present system may be configured to be either portable or stationary.

Prior art devices used to generate a water/air fire fighting foam either used aspirated air in the foam generating unit or used a compressed gas under high pressure.

Aspirated type foam generators have a low foam expansion rate (a foam to foam solution volume ratio of between about 1:1 and 20:1), require a large amount of foam concentrate to develop foam (a minimum of 0.05% of foam concentrate in water, but more typically about 1.0%), and the foam generated does not have the durability of compressed air foam generators. Aspirated nozzles require high pressures to develop acceptable fire suppressant foam, generally requiring a minimum pressure of 100 psig.

Prior art compressed gas foam generators used compressed gas under a very high pressure of above 100 psig and as high as 300 psig. For example, the device disclosed in U.S. Pat. No. 3,977,474 utilizes gas at a pressure of 300 psig to pressurize a water reservoir tank. Such high pressures present a safety hazard for a single operator and would require several highly trained operators for safe operation. Such high pressure operation would deplete a reservoir type water supply very rapidly.

It is an object of the present invention to provide a low pressure, self-contained fire suppression system that can be safely operated by a single, untrained operator, that is user friendly (requiring the opening of only one valve to commence foam generation), that is easily recharged, and that is capable of generating a dry, fire suppressing foam for a substantial period of time.

SUMMARY OF THE INVENTION

The present invention is a low pressure, self-contained fire suppression system comprising at least one tank for holding a gas under pressure, at least one tank containing water, and a foam concentrate tank. A water driven volumetric metering pump communicates via conduits with the pressurized gas tank, the water tank and the foam concentrate tank. Conduits also communicate the pressurized gas tank with both the water tank and the outlet of the metering pump. A conduit communicates the foam concentrate tank with the metering pump.

A single valve is located in the piping connecting the pressurized gas tank to the water tank and the metering pump to permit easy actuation of the system during an emergency.

A pressure regulator is located in the conduit communicating the pressurized gas tank with the water tank and metering pump. The pressure regulator is adjusted to provide, during operation, gas at a pressure between about 30 and about 70 psig.

In operation, when the valve connecting the pressurized gas tank to the water tank and the metering pump is opened, pressurized gas entering the water tank forces water out of the tank and into the metering pump. The action of the water passing through the metering pump draws foam concentrate from its tank into the metering pump where it is mixed with the water. Gas from the pressurized gas tank is also introduced into the water/foam concentrate mixture at the exit side of the metering pump. The exit side of the metering pump is connected to a flexible conduit such as a hose. The water, foam concentrate and gas mixture generates a foam in the hose which, upon exiting the hose, can be directed to the fire to be suppressed or to a structure to be protected from an approaching fire.

The gas used in the present invention may be either air or a non-combustion supporting gas such as nitrogen.

The low pressure, self-contained fire suppression system of this invention is easy to operate in an emergency, requiring only that the valve located at the outlet of the pressurized gas tank be opened to pressurize the system and commence foam generation. The system is portable and self-contained (requiring no hookups to power or water sources).

DESCRIPTION OF THE PREFERRED EMBODIMENTS

Figure 1:
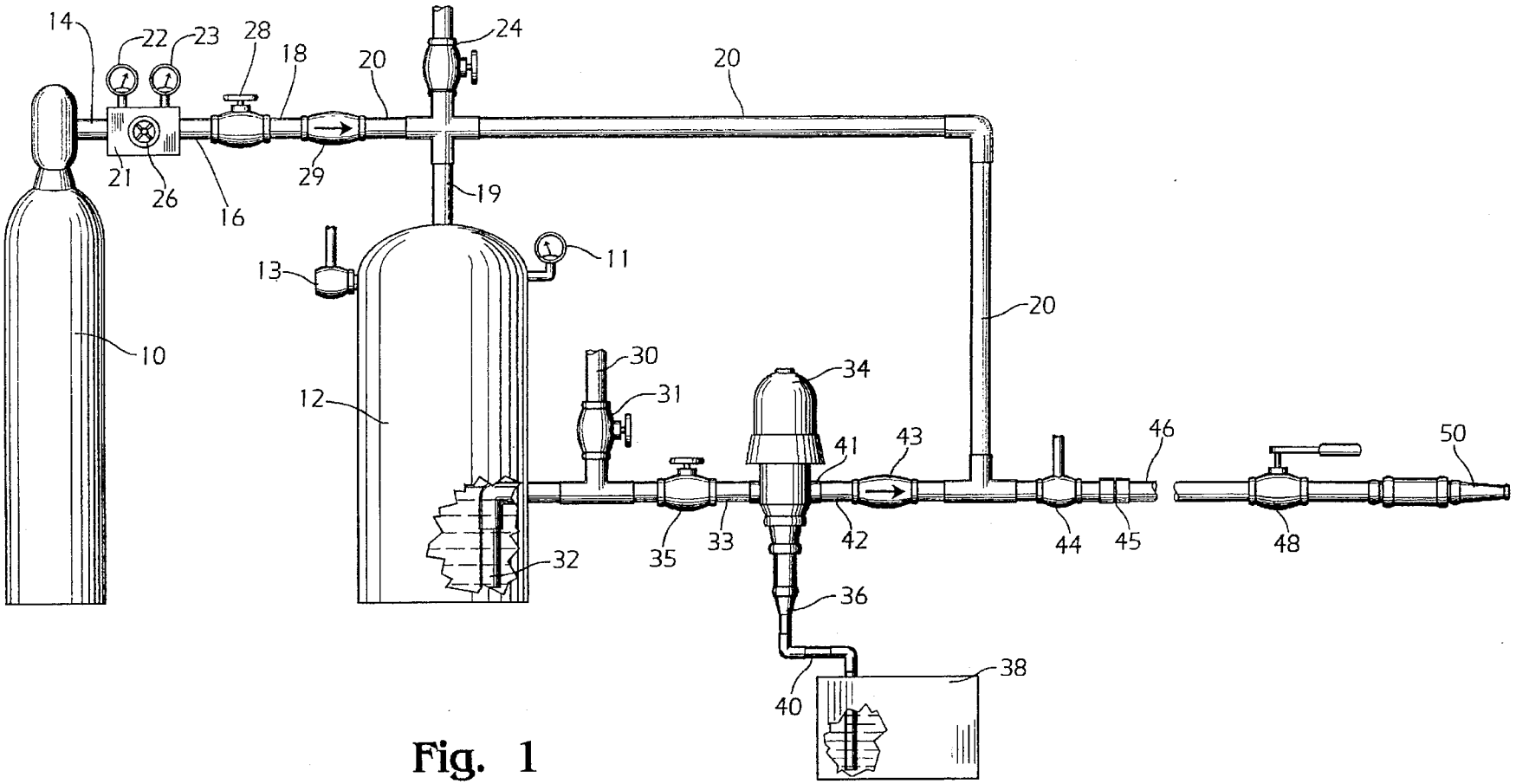
FIG. 1 is an elevational view, partly broken away, of a low pressure, self-contained fire suppressant apparatus of this invention.

Referring to FIG. 1, a pressurized gas tank 10 communicates with the upper part of water tank 12 via rigid conduits 14, 16, 18, 19 and flexible conduit 20. Pressure regulator 21 comprised of pressure gages 22 and 23 and valve 26 communicates with conduit portions 14 and 16, respectively.

Water tank 12 has an inlet 30 and associated valve 31 suitable for connection to a source of water by means of a conduit, such as a hose, for filling tank 12 with water. During filling valve 24 is cracked to permit air trapped inside the tank to escape.

Water tank 12 has an outlet conduit 32 located in the bottom portion thereof communicating with a first inlet port 33 of a suitable water driven volumetric metering pump 34. As pump 34 is water driven it requires no source of power for operation. A water flow regulator valve 35 is located upstream of inlet port 33 which can be adjusted to provide a very wet or very dry foam by adjusting the water content thereof. Very dry foams are preferred for protective purposes; very wet foams for direct suppression of a fire.

A second inlet port 36 of pump 34 communicates with a foam concentrate tank 38 via flexible conduit 40. The foam concentrate employed forms no part of this invention, and may be any fire suppressant concentrate commercially available. For example, a foam concentrate marketed by Monsanto under the name WD 881 is suitable for use in practicing the present invention. The system described herein generates foam using about 0.02% to about 0.03% of foam concentrate in water which is much less than the amount required in aspirated type foam generators.

Outlet 41 of pump 34 is connected to conduit 42 which communicates with the pressurized gas source 10 via flexible conduit 20. Check valve 43 is located in conduit 42 upstream of its intersection of flexible conduit 20. Downstream from the intersection of conduit 42 and flexible conduit 20 is a safety relief valve 44 and a suitable coupling fixture 45 for connecting the combined output from pump 34 and the pressurized gas introduced via flexible conduit 20 to a foam delivery conduit 46. Conduit 46 is, preferably, a flexible conduit such as a hose, but may be rigid plastic or metal pipe. Foam delivery conduit 46 has a valve 48 (preferably a quick opening type valve) located near the terminus thereof and a nozzle 50 located at the terminus.

In operation, valve 28 is opened to permit pressurized gas to enter the upper part of water tank 12, thereby pressurizing tank 12 and forcing water therefrom via outlet 32 into the first inlet port 33 of pump 34. Water flowing through pump 34 draws foam concentrate from concentrate tank 38 into the pump 34 at a predetermined volumetric flow rate by way, for example, of a water driven pumping action involving a piston.

The volumetric flow rate chosen for the metering pump depends on the volume per unit time desired. An advantage of the present invention is that it can operate at low volumetric flow rates. For example, a suitable volumetric metering pump device suitable for many applications is an 11 gallon per minute volumetric metering pump manufactured by Dosatron International Inc.

The water and foam concentrate are mixed together in pump 34 and the water/foam concentrate mixture exits pump 34 through outlet port 41.

It has been found that in order to generate a good water/air foam that the pressure of the air (or other gas) introduced into the water/foam concentrate stream be at substantially the same pressure as the water/foam concentrate stream. In the present system this is achieved automatically by providing that the pressurized gas used to pressurize water tank 12 comes from the same source (pressurized gas tank 10, as adjusted by pressure regulator 21) as the pressurized gas stream fed into the water/foam concentrate stream via flexible conduit 20. A water/gas foam is generated in flexible conduit 46 from the water/foam concentrate/gas mixture created at the intersection of outlet conduit 42 and pressurized gas conduit 18.

Flexible conduit 46 is preferably a hose having a diameter of at least about ¾ inch (the diameter of a garden hose) up to about one inch.

Opening valve 48 in conduit 46 permits the water/gas foam to pass through nozzle 50 where it can be directed to a fire or onto a structure to protect it against an approaching fire.

As discussed above the pressure of the gas stream used to pressurize water tank 12 and generate the water/gas foam at the exit of pump 34 is maintained lower than prior art systems. This permits wet or dry foam to be generated while permitting operation at safe pressures and generation of foam for longer periods of time than prior art devices.

A "dry" foam is one which contains small to medium sized bubbles consisting primarily of the gas employed to pressurize the system. Dry foams have slow drain times, i.e., stay in place longer to provide protection over an extended period of time. "Wet" foams contain more water than dry foams and are used for direct suppression of a currently existing fire.

The fire suppression system of this invention generates a medium expansion foam, i.e., one having an expansion rate between about 20:1 through 200:1, thus providing the ability to generate wet to very dry foam combinations.

The gas pressure under which the system is operated is set by reading pressure gage 11 on water tank 12 and adjusting valve 26 of pressure regulator 21. Pressure regulator 21 should be set to provide a pressure to the system of between about 30 and about 70 psig, preferably in the range of normal domestic water pressures of between about 30 and about 50 psig. Such pressures are sufficient to generate a foam stream in a one inch hose that can be projected for a distance of up to about 35 feet beyond the tip of nozzle 50.

The pressurized gas tank 10 may contain either air or a gas not supporting combustion, such as nitrogen. Such pressurized gas tanks are readily available from industrial welding gas supply companies, and typically contain the compressed gas at a pressure of about 2000 psig. Although the invention has been described as employing a single pressurized gas tank 10, multiple tanks may also be employed.

While the invention has been described by reference to an apparatus having a single water tank 12, multiple tanks connected either in series or in parallel to the pressurized gas tank may be used so long as the water and gas pressure of the system can be maintained between about 30 and about 70 psig.

Figure 2:
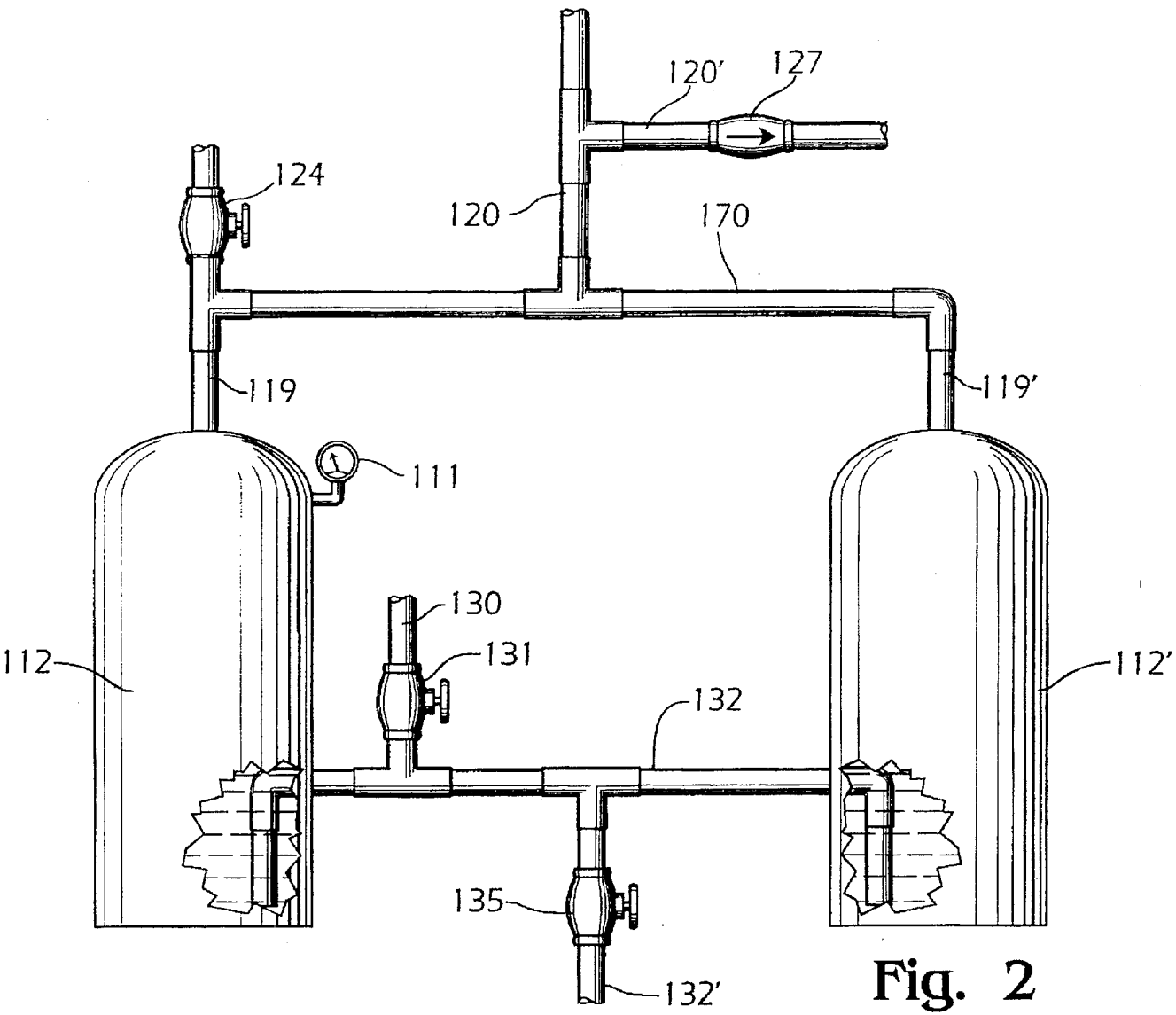
FIG. 2 is an elevational view of an alternative embodiment of the apparatus illustrated in FIG. 1.

FIG. 2 illustrates an alternative embodiment to that illustrated in FIG. 1 which employs two water tanks 112 and 112' connected in parallel. Compressed gas from a tank (not shown) is fed to the system via flexible conduit 120. Flexible conduit 120 communicates with rigid conduit 170 which, in turn, communicates with rigid conduits 119 and 119' which communicate with the interior of water tanks 112 and 112', respectively. Flexible conduit 120' communicates with the output side of a metering pump (not shown) in the same manner as in the embodiment illustrated in FIG. 1. Rigid conduit 132 communicates with water tanks 112 and 112' in the lower portions thereof. Inlet 130 and associated valve 131 can be connected to a source of water by means of a hose for filling tanks 112 and 112' with water. During filling valve 124 is cracked to permit air trapped inside the tank to escape. Outlet conduit 132' communicates with conduit 132 and with a metering pump (not shown) in the same manner as shown in the embodiment illustrated in FIG. 1. A water flow regulator valve 135 is located in conduit 132'.

Figure 3:
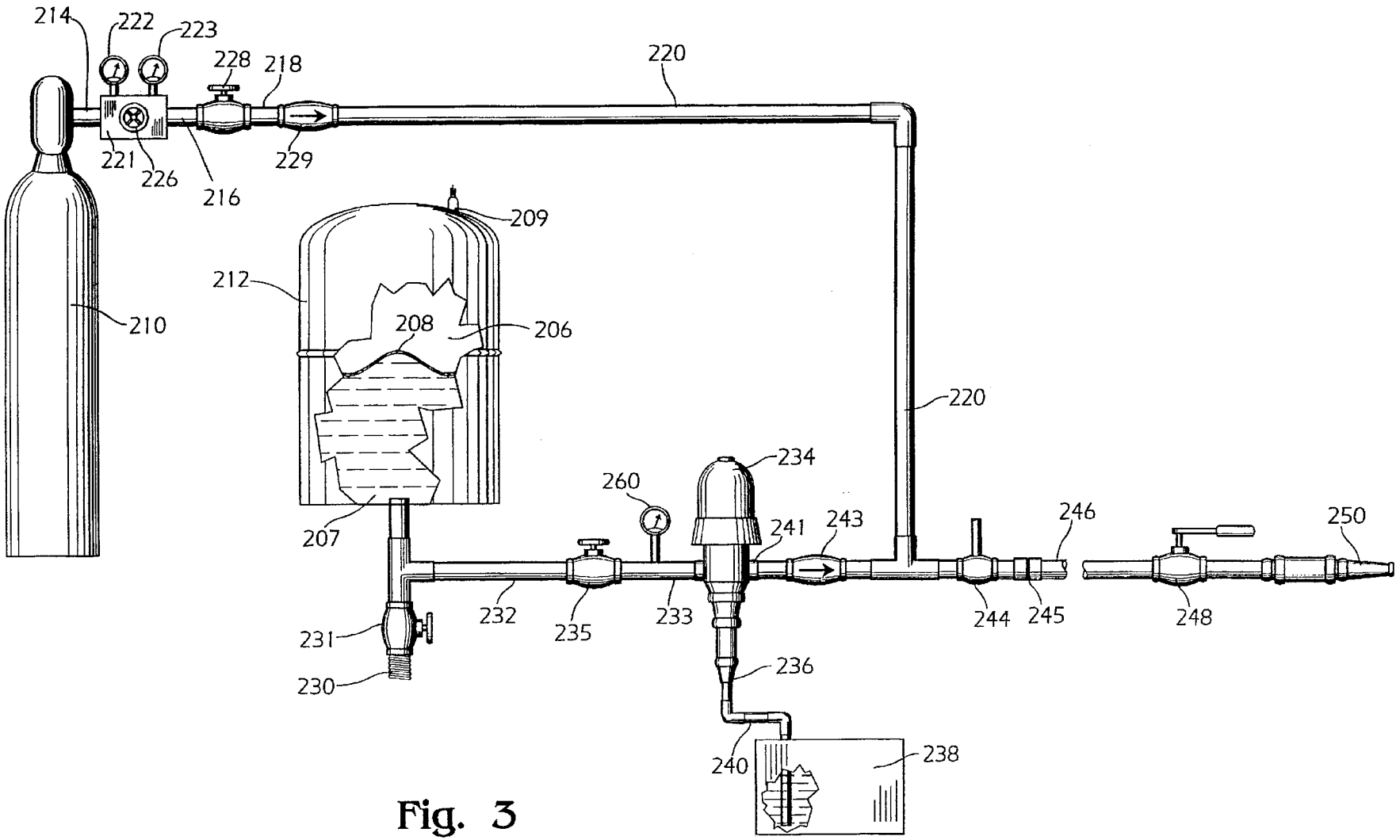
FIG. 3 is an elevational view in partial cross section of a further alternative embodiment.

FIG. 3 illustrates an alternative embodiment of the water reservoir tank of the present invention. In FIG. 3 water reservoir tank 212 is of the diaphragm pressure type used in rural areas to supply household water. Tank 212 has a diaphragm 208 separating an air chamber 206 located in the upper portion of tank 212 and a water chamber 207 located in the lower portion of tank 212. The tank 212 is pressurized to a pressure between about 30 and about 70 psig, preferably between about 30 and about 50 psig, by connection to a suitable air supply via valve stem 209. Water is then introduced into the tank via connection 230 with valve 231 in the open position and valve 235 in the closed position. As the tank 212 fills with water it presses against diaphragm 208 and the air pocket located in space 206 located in the upper part of tank 212. When water is withdrawn from the tank 212 the pressure remains substantially constant until the tank is almost empty in which case, in typical installations, a drop in pressure activates a water pump and water is then automatically pumped into the tank to the desired level. Pressurized air or nitrogen is fed from gas tank 210 via conduit 214, pressure regulator 221, conduit 216, valve 228, conduit 218, check valve 229 and conduit 220 to the outlet side 241 of metering pump 234. Water outlet conduit 232 communicates water tank 212 with the first inlet port 233 of metering pump 234 while foam concentrate tank 238 communicates with the second inlet port 236 of metering pump 234 via conduit 240.

In the operation of the modified embodiment illustrated in FIG. 3, valves 228 and 235 must both be opened to actuate the system. The pressure of the air or nitrogen introduced into the outlet side of metering pump 234 is adjusted to a predetermined pressure by valve 226, which said predetermined pressure is the same as the pressure maintained inside water tank 212. This predetermined pressure is generally that used for domestic water supply, i.e., generally between about 30 and about 70 psig and preferably between about 30 and about 50 psig. Gage 223 displays the set pressure of the air or nitrogen to be introduced into the outlet port 241 of metering pump 234. The pressure inside water tank 212 is read by connecting an ordinary tire air pressure gage to valve stem 209. As in the other embodiments, the water, foam concentrate air mixture passes into hose 246 where a foam is generated. The foam then passes through nozzle 250 with valve 248 in the open position and is directed to the appropriate location.

While preferred embodiments of the invention have been described herein, modifications are possible which will fall within the scope of the invention as claimed hereinbelow.

I claim:

1. A low pressure, self-contained fire suppression apparatus comprising:

at least one gas tank for providing a source of gas under pressure;

at least one water tank for providing a source of water under pressure;

a foam concentrate tank for providing a source of foam concentrate;

a water driven volumetric metering pump having a first inlet port, a second inlet port, and an outlet port; said first inlet port communicating via a water conduit with the water in said water tank; said second inlet port communicating via a concentrate conduit with the foam concentrate in said foam concentrate tank;

a gas conduit communicating said gas tank with the outlet port of said metering pump;

a water pressure control valve in said water conduit and a gas pressure control valve in said gas conduit, said water pressure control valve and said gas pressure control valve providing water and gas at substantially the same pressure; and a foam conduit communicating said outlet port of said metering pump with a foam dispensing outlet.

2. The apparatus of claim 1 wherein said gas conduit also communicates with said water tank to thereby pressurize the water to substantially the same pressure as the pressure of the gas introduced into the outlet port of said metering pump.

3. A low pressure, self-contained fire suppression apparatus comprising:

at least one gas tank for providing a source of gas under pressure;

at least one water tank for providing a source of water under pressure;

a foam concentrate tank for providing a source of foam concentrate;

a water driven volumetric metering pump having a first inlet port, a second inlet port, and an outlet port; said first inlet port communicating via a water conduit with the water in said water tank; said second inlet port communicating via a concentrate conduit with the foam concentrate in said foam concentrate tank;

a gas conduit communicating said gas tank with said water tank and with said outlet port of said metering pump whereby the pressure of the water in said water tank and the pressure of the gas being introduced into the outlet port of said metering pump are substantially the same;

a single valve in said gas conduit, which said valve, when placed in the open position actuates the generation of foam by said apparatus; and foam conduit means communicating the outlet port of said metering pump with a foam dispensing outlet.

4. The apparatus of claim 3 including a pressure regulator located in said gas conduit for establishing and maintaining the pressure of the water in said water reservoir tank and the gas introduced into said outlet port of said metering pump at substantially the same pressure of between about 30 and about 70 psig.

5. The apparatus of claim 3 wherein said foam dispensing output conduit is a flexible hose having a valve and nozzle assembly at its terminus.

* * * * *